US010286690B2

(12) United States Patent
Sanchis Estruch et al.

(10) Patent No.: US 10,286,690 B2
(45) Date of Patent: May 14, 2019

(54) PRINT ZONE ASSEMBLY, PRINT PLATEN DEVICE, AND LARGE FORMAT PRINTER

(71) Applicant: HEWLETT-PACKARD DEVELOPMENT COMPANY, L.P., Houston, TX (US)

(72) Inventors: Ricardo Sanchis Estruch, Sant Cugat del Valles (ES); Pau Martin Vidal, Sant Cugat del Valles (ES); Alberto Arredondo, Sant Cugat del Valles (ES); Alejandro Puente, San Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 34 days.

(21) Appl. No.: 15/312,713

(22) PCT Filed: Jun. 2, 2014

(86) PCT No.: PCT/EP2014/061339
§ 371 (c)(1),
(2) Date: Nov. 21, 2016

(87) PCT Pub. No.: WO2015/185085
PCT Pub. Date: Dec. 10, 2015

(65) Prior Publication Data

US 2017/0239959 A1 Aug. 24, 2017

(51) Int. Cl.
*B41J 11/06* (2006.01)
*B41J 11/00* (2006.01)
*B41J 11/04* (2006.01)

(52) U.S. Cl.
CPC ..... *B41J 11/06* (2013.01); *B41J 11/0085* (2013.01); *B41J 11/04* (2013.01)

(58) Field of Classification Search
CPC ..... B41J 11/06
See application file for complete search history.

(56) References Cited

U.S. PATENT DOCUMENTS 6,036,380 A 3/2000 Astroth
6,582,071 B1 * 6/2003 Belbey ..... B41J 11/002 347/103

(Continued)

FOREIGN PATENT DOCUMENTS

EP 1726446 A1 11/2006
JP 2001130070 A 5/2001

(Continued)

OTHER PUBLICATIONS

Hewlett Packard Developnent Company, L.P. HP DesignJet Z6100 Series Printers: High Productivity at High Image Quality, Mar. 2007.

*Primary Examiner* — Kristal Feggins
*Assistant Examiner* — Kendrick X Liu
(74) *Attorney, Agent, or Firm* — HP Inc. Patent Department

(57) ABSTRACT

Described is a print zone assembly comprising a print platen device including at least a section of a print platen, hiving a first dimension and a second dimension, the second dimension being perpendicular to the first dimension, wherein the print platen device has a higher rigidity in the direction of the second dimension and a lower rigidity in the direction of the first dimension; and a platen support structure supporting the print platen device at a number of references, establishing a multi-point contact, wherein the print platen device conforms to the references for providing a flat platen surface.

13 Claims, 6 Drawing Sheets

(56) References Cited

U.S. PATENT DOCUMENTS

| | | | | |
|---|---|---|---|---|
| 6,672,706 | B2 | 1/2004 | Silverbrook | |
| 6,672,720 | B2 | 1/2004 | Smith | |
| 8,356,889 | B2 | 1/2013 | Rosati et al. | |
| 2002/0067401 | A1 | 6/2002 | Yraceburu | |
| 2004/0239742 | A1* | 12/2004 | Hiraki | B41J 11/0085 347/104 |
| 2007/0177923 | A1 | 8/2007 | Eoka | |
| 2008/0174652 | A1* | 7/2008 | Schmid | B41J 11/0085 347/104 |
| 2010/0157006 | A1* | 6/2010 | Kanada | B41J 11/06 347/102 |
| 2014/0028768 | A1 | 1/2014 | Chen | |

FOREIGN PATENT DOCUMENTS

| | | | | |
|---|---|---|---|---|
| JP | 2003096658 | A | | 4/2003 |
| JP | 2010046859 | A | * | 3/2010 |
| JP | 2010046859 | A | | 3/2010 |
| JP | 2013193219 | A | | 9/2013 |

* cited by examiner

PRINT ZONE ASSEMBLY, PRINT PLATEN DEVICE, AND LARGE FORMAT PRINTER

Some printers, such as large format printers, may need a very controlled flat surface providing a flat horizontally aligned print zone to print in this area on a print medium. Having a flat print zone, the dimensions of the printhead-to-paper spacing (PPS) can be controlled precisely in order to minimize any impact on the image quality due to different PPS throughout the to print zone.

Examples of the present disclosure are described below with reference to the drawings wherein.

The present disclosure is directed at a print zone assembly, a print platen device used in the print zone assembly and a large, format printer using such a print zone assembly. Examples of the print zone assembly comprise a print platen device, wherein the print platen device can include one or more print platen modules, and a platen support structure. The print platen module may include an entire print platen and an associated vacuum subsystem or it may be combined with additional print platen module to provide the print zone assembly. A print zone assembly hence may comprise one print platen module or two, three, four or more similar print platen modules, arranged side by side. Accordingly, the print platen may be constructed from a single-part print platen or from a number of print platen sections, such as in the module shown in FIGS. 5 and 6. The print platen module shown and describe herein has a first dimension, also designated as longitudinal dimension, which extends in the direction of print media transport, and a second dimension, also referred to as transverse dimension, which is perpendicular thereto.

FIGS. 1 to 4 show parts of a print platen module 10, including a print platen section 11 provided with stiffening ribs 12 and a pan 20 for forming a vacuum chamber. The stiffening ribs 12 extend along the bottom side of the print platen section 11 in the direction of the transverse dimension. In this example, the print platen section 11 is an injection molded part made from a plastic material, such as polycarbonate (PC) or PPO. The stiffening ribs 12 are stamped metal sheet parts which can be integrated with the print platen section 11 during the molding process, e.g. by overmolding. When the print platen section is formed by injection molding, for example, the stiffening ribs may be over-molded during the injection molding process. Other constructions could be used for coupling the stiffening, ribs to the print platen.

Figure 1:
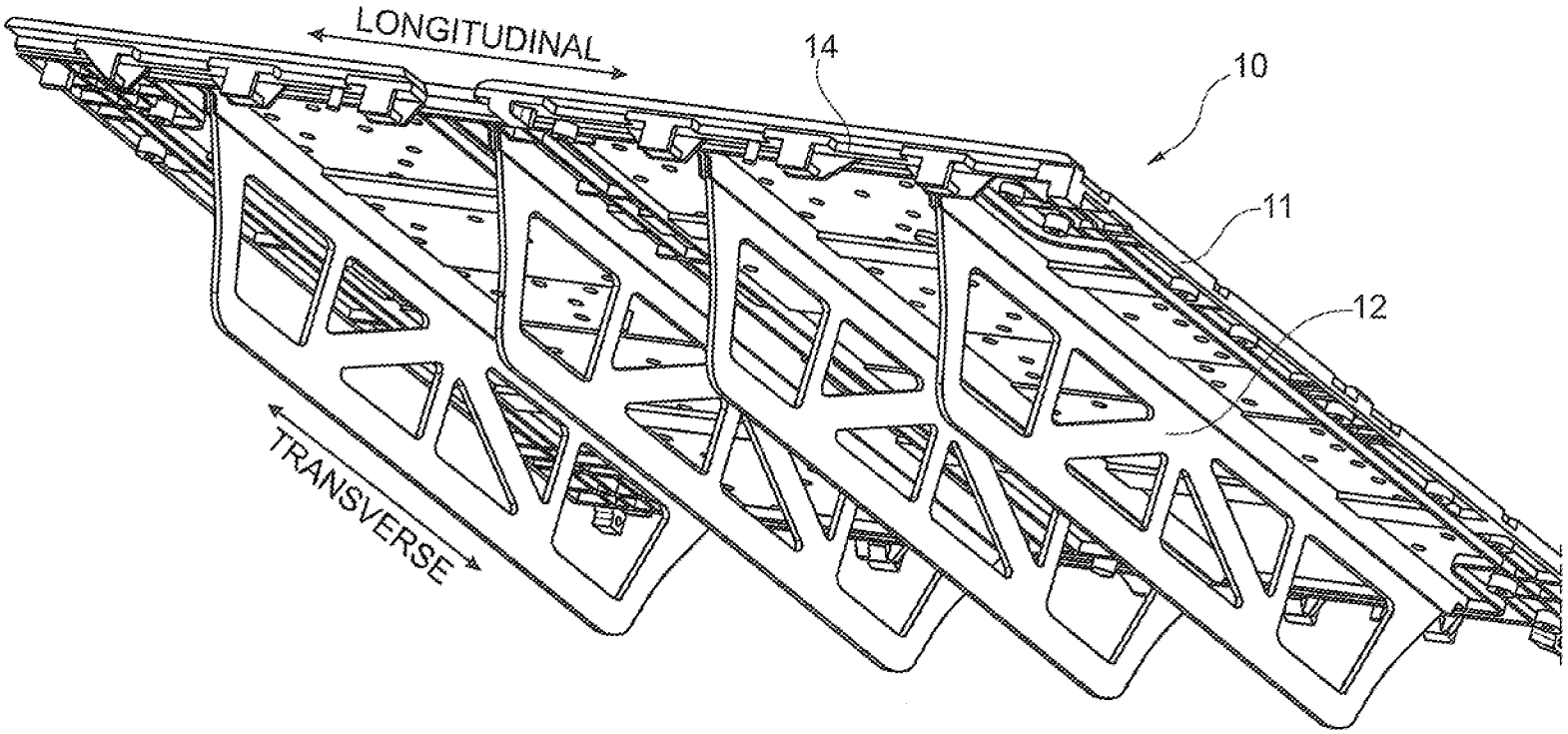
FIG. 1 shows a bottom view of an example of part of a print platen module.

Also shown in FIG. 1 is a fitting edge 14 of the print platen section 10, the fitting edge being provided for connecting several adjacent print platen modules in an overlapping manner to form an entire print platen.

Figure 2:
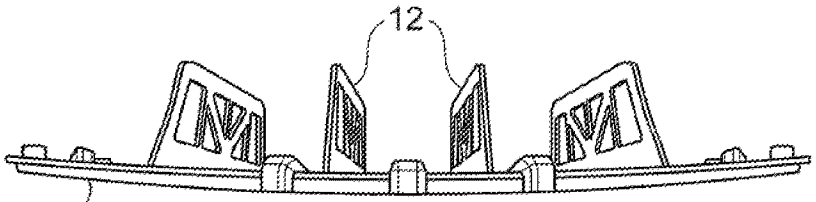
FIG. 2 shows an example of a similar print platen, module part for illustrating physical properties thereof.

As shown in FIG. 2, the print platen module 10 is designed in such a way that it is more rigid in the transverse direction than in the longitudinal direction. It hence can be bent more easily in the longitudinal direction, as shown in FIG. 2, whereas it is hardly bendable in the transverse direction. In different examples of this disclosure, the stiffness of the print platen module 10 in the transverse direction is about 100 times to 500 times its stiffness in the longitudinal direction.

The print platen device will be supported by a platen support structure (described below) at a number of references, establishing a multi-point contact wherein the print platen device, including one or more modules 10, conforms to these references to provide a flat platen surface. A platen surface is flat when its surface stays within some defined level of tolerance to a plane; in one example, a deviation from a perfect plane of e.g. 0.1 mm may be acceptable. As described in further detail below, the print platen support structure may comprise an adjustment mechanism to allow the print platen device to be supported at a predetermined flatness. The print zone flatness hence may be adjusted throughout the extension of the print zone, taking advantage of some compliance of the print platen modules 10. These partially compliant print platen modules 10 are able to copy external rigid references provided by the print platen support structure, described further below. It hence is not necessary to pre-machine or post-machine any reference Once the print platen modules are attached to the support structure, the print zone should have achieved its desired flatness. It is not necessary to perform any post-machining of the print platen modules once assembled or machining the platen support structure before assembly. The compliance of the print platen modules, in the example described, is achieved by a hybrid construction including print platen sections 11 made from plastic material and enforced by 2o transversal sheet metal stiffening ribs 12 over-molded by the material of the print platen module. This increases the rigidity in the print zone area in the transverse direction but allows the print platen module to be slightly twisted and bended to conform against external references in the longitudinal direction. The print platen module 10 of the examples of this disclosure further comprises a vacuum chamber attached to the bottom side of the print platen section 11. The vacuum chamber is sufficiently soft not to introduce tension or torsion when attaching the vacuum chamber to the print platen and mounting the print platen module on the support structure without distorting and /or introducing any deformation.

Figure 3:
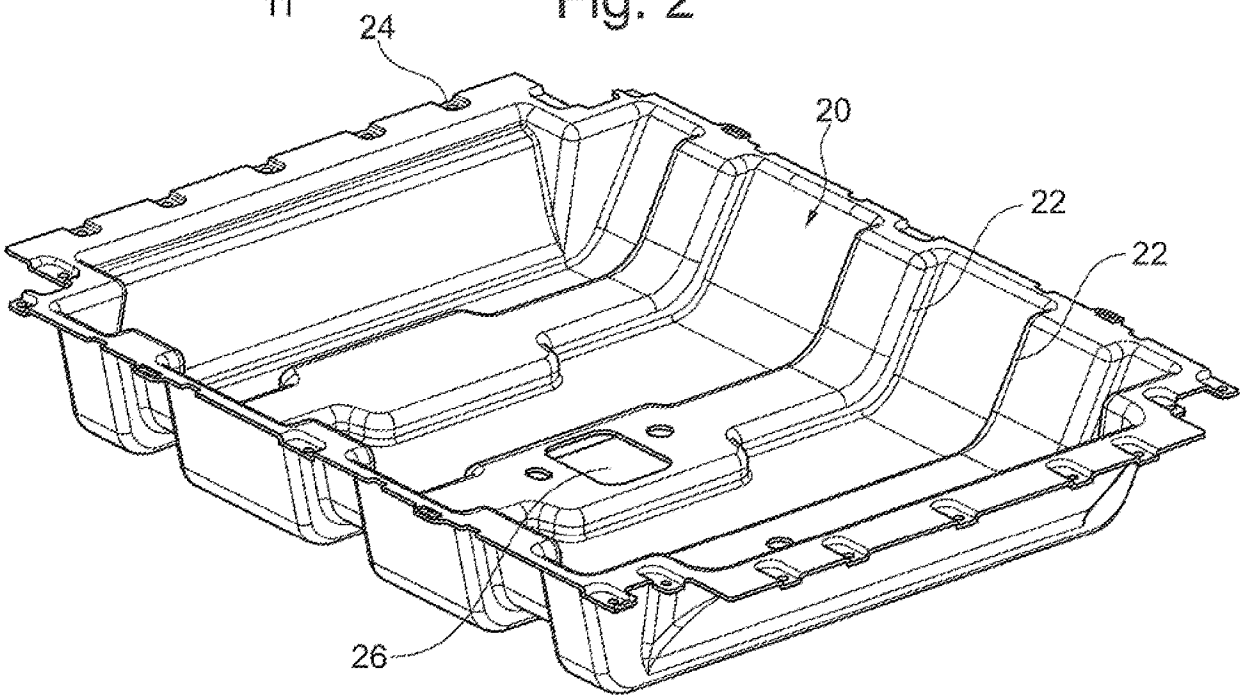
FIG. 3 shows an example of a pan of a vacuum chamber to be used in combination with the part shown in FIG. 1 to provide a print platen module.

An example of a pan 20 of a vacuum chamber is shown in FIG. 3.

Figure 4:
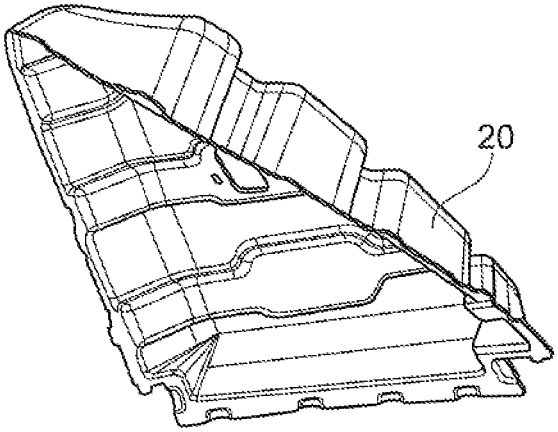
FIG. 4 shows an example of a similar pan of a print platen module for illustrating physical properties thereof.

The pan 20 together with the bottom side of the print platen section 11 defines the vacuum chamber. The pan 20 can be produced by thermoforming of a polymer, such as polystyrene to form a soft bendable part, as illustrated in FIG. 4. A wall thickness of the pan can be in the order of 1 to 2 millimeters, for example about 1.5 mm The shape of the pan 20 does not have to meet any particular level of accuracy. The structure—which is defined by its geometry, the material used and the wall thickness—shall be sufficiently strong to support the vacuum level applied to the print platen assembly without breaking or collapsing. It also will be sufficiently soft not to introduce any tension or torsion to the print platen when the pan 20 is mounted to the bottom side of the print platen section 11 and when the print platen module is mounted to its support structure. In the example shown in FIG. 3, the pan 20 has a corrugated structure including ribs 22 for increasing the stiffness of the pan wall. In one example, the vacuum level applied to the print platen may be in the order of 100 to 250 mm of $H_2O$ corresponding to about 1000 to 2500 $N/m^2$.

The pan 20 comprises mounting holes 24 for mounting the pan to the bottom side of the print platen, using screws, rivets or the like. It further comprises a vacuum inlet 26, for connection to a vacuum tube.

FIG. 4 shows a pan 20 which is twisted manually to illustrate the soft bendable character of the pan. When compared to the stiffness of the print platen section 11, including stiffening ribs 12, the flexural inertia moment in the transverse direction of the print platen section 11, including the over-molded strip 12 is about 50000 times bigger than that of the pan 20.

Figure 5:
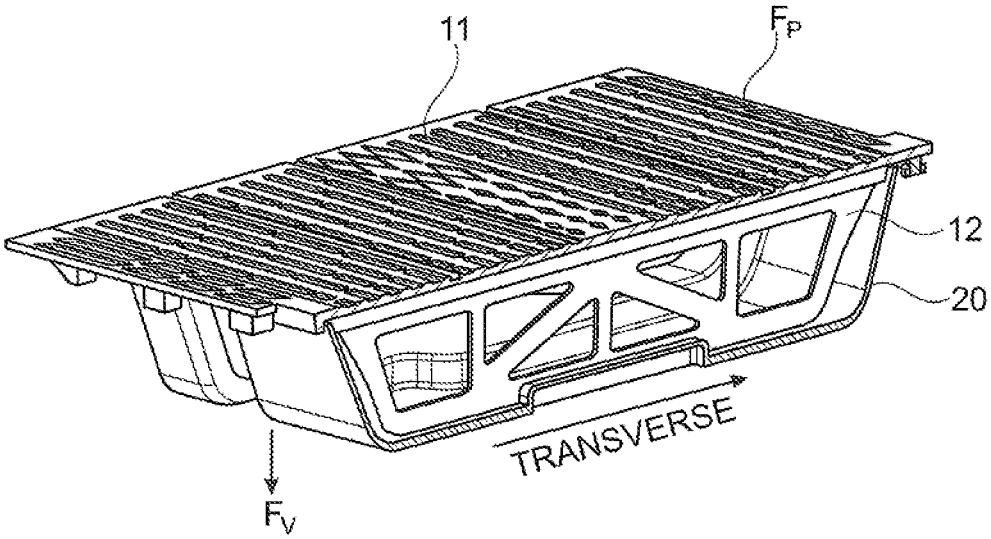
FIG. 5 shows a sectional view through a print platen module including the parts shown in FIGS. 1 and 3.
Figure 6:
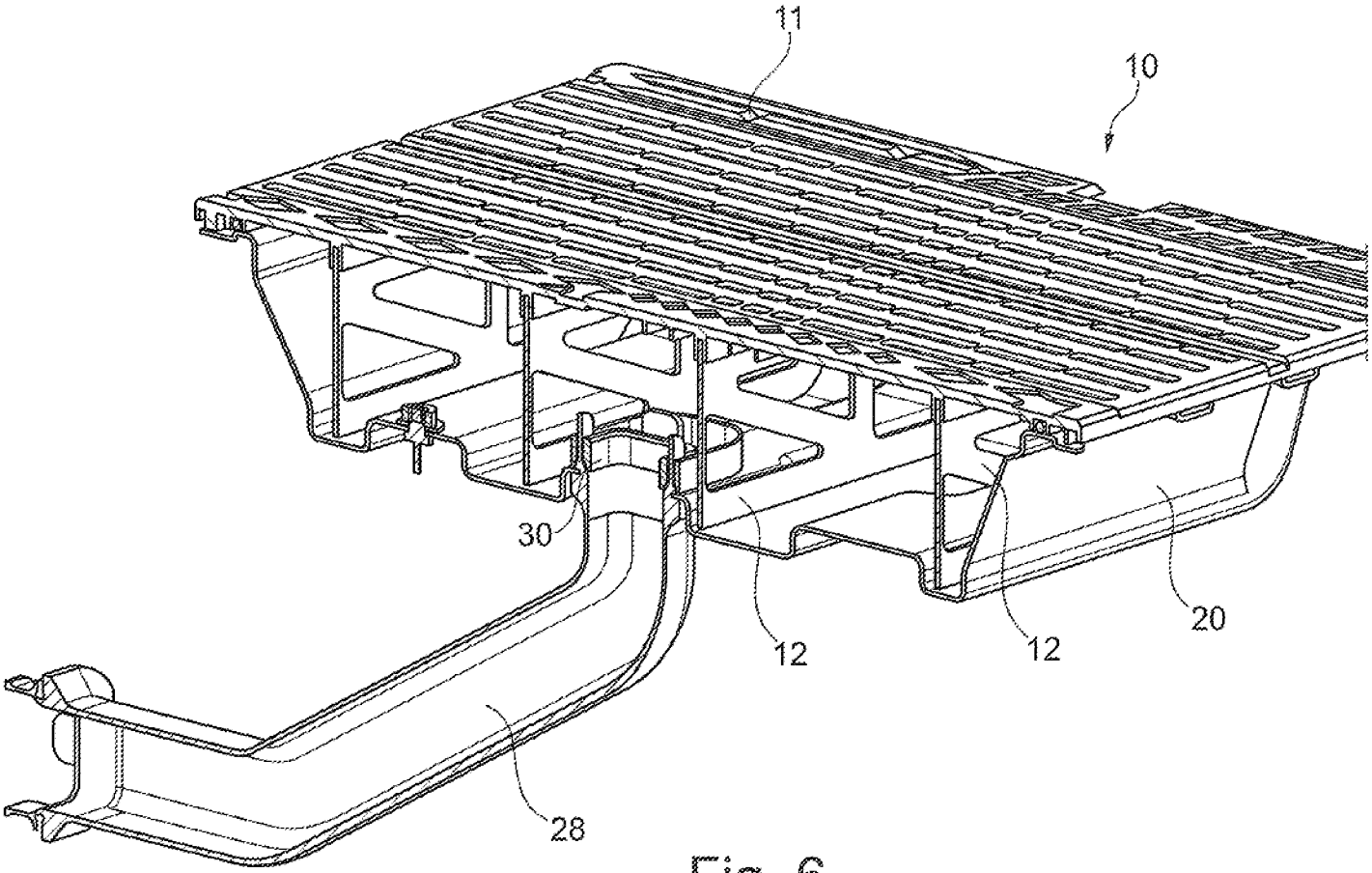
FIG. 6 shows another sectional view through the print platen module of FIG. 5.

FIGS. 5 and 6 show different sectional views through a print platen module including the print platen section 11, stiffening ribs 12, the pan 20, and a vacuum tube 28 connected to vacuum inlet 26 by a vacuum connector 30. FIG. 5 illustrates how the pan 20 is connected to the bottom side of the print platen section 11. FIG. 5 also illustrates that the stiffness or rigidity of the print platen section 11 in the transverse direction is a lot higher than that of the pan 20 so that the print platen can withstand much higher bending forces $F_p$ than the vacuum chamber ($F_v$). In one example, the rigidity of the print platen section 11, including the over-molded ribs 12, is about 200 times larger than the flexural rigidity of the pan 20 of the vacuum chamber in the transverse direction. The pan 20 hence should not introduce torsional and flexural tensions to the print platen when the vacuum chamber is mounted to the bottom side of the print platen section 11.

Figure 7:
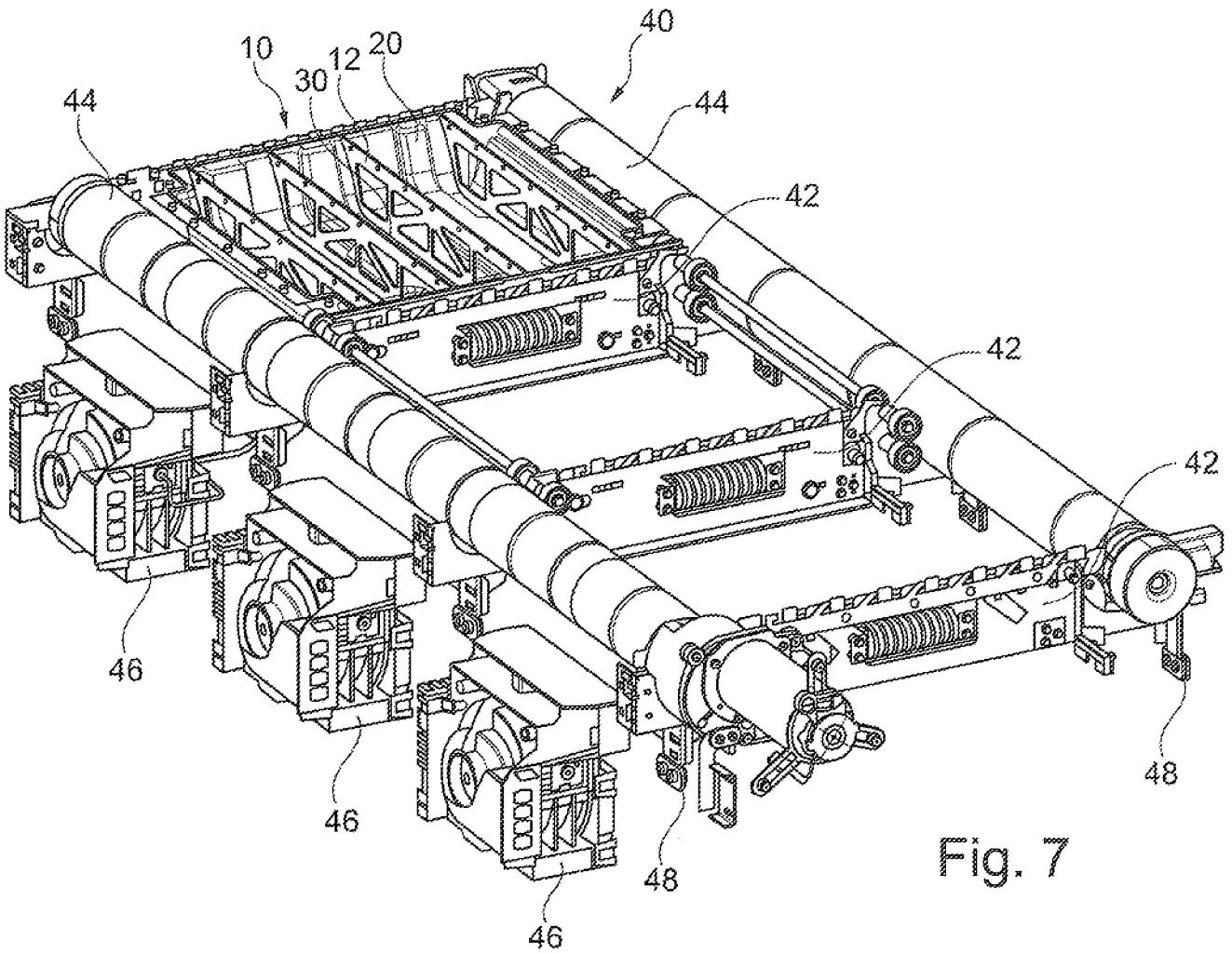
FIG. 7 shows parts of a large format printer in a semi-assembled state for illustrating how the print platen module is supported in the printer structure.

FIG. 7 shows parts of a large format printer in a semi-assembled state for illustrating how the print platen module is supported in the printer structure and how an example of the print zone assembly may be designed. For better illustrating how the print platen modules are supported within the printer, only one print platen module 10 is shown with the print platen section 11 removed. The structure shown in FIG. 7 comprises, besides the print platen module 10, support beams 42 arranged between two belt rollers 44 supported by beams 42. The print platen sub-system 40 further comprises vacuum generators 46 which are to be connected with the vacuum tube 28 for providing the print platen modules 10 with an appropriate vacuum. The support beams 42 are associated with an adjustment mechanism which moves up and down tabs 48, this mechanism adjusting the print zone to a defined level of flatness.

In the example shown in the figures, three print latex modules 10 are supported side by side to form an entire print platen having a vacuum sub-system. Each print platen, module 10 is supported by two support beams 42 providing references for the print platen module 10 to rest against. By using the adjustment mechanism of the support structure, the print zone flatness can be adjusted throughout the print zone due to the compliance of the print platen modules 10 in the longitudinal direction. Because the pan 20 of the vacuum chamber is relatively soft and bendable, it should not introduce any twist or torsion during this adjustment process. The compliant print platen module 10 hence can copy the external rigid references given by the support beams 42 and possibly other structural parts of the print zone. Once the flatness of the print zone has been adjusted, the beams 42 are fixed to the underlying print zone support structure, using e.g. screws, and the flatness adjustment process is complete. This concept avoids post-machining the print platen module once assembled or machining the support structure and support beams before assembly. Once the print platen modules 10 have been assembled and attached to the support beams 42 and/or other supporting structure, the rigidity of the overall system is increased considerably and the print platen modules 10 should provide a rigid flat print platen surface. However, by providing initially compliant print platen modules, the final print zone assembly should be free of any torsion forces and should meet defined flatness specifications throughout the area of the print zone. The mounting process also is surprisingly fast and allows to reliably inspect the flatness of each of the print platen modules as well as of the overall print zone flatness during the adjustment process in real time in the assembly line, rather than only after the complete print platen sub-system 40 has been assembled.

Figure 8:
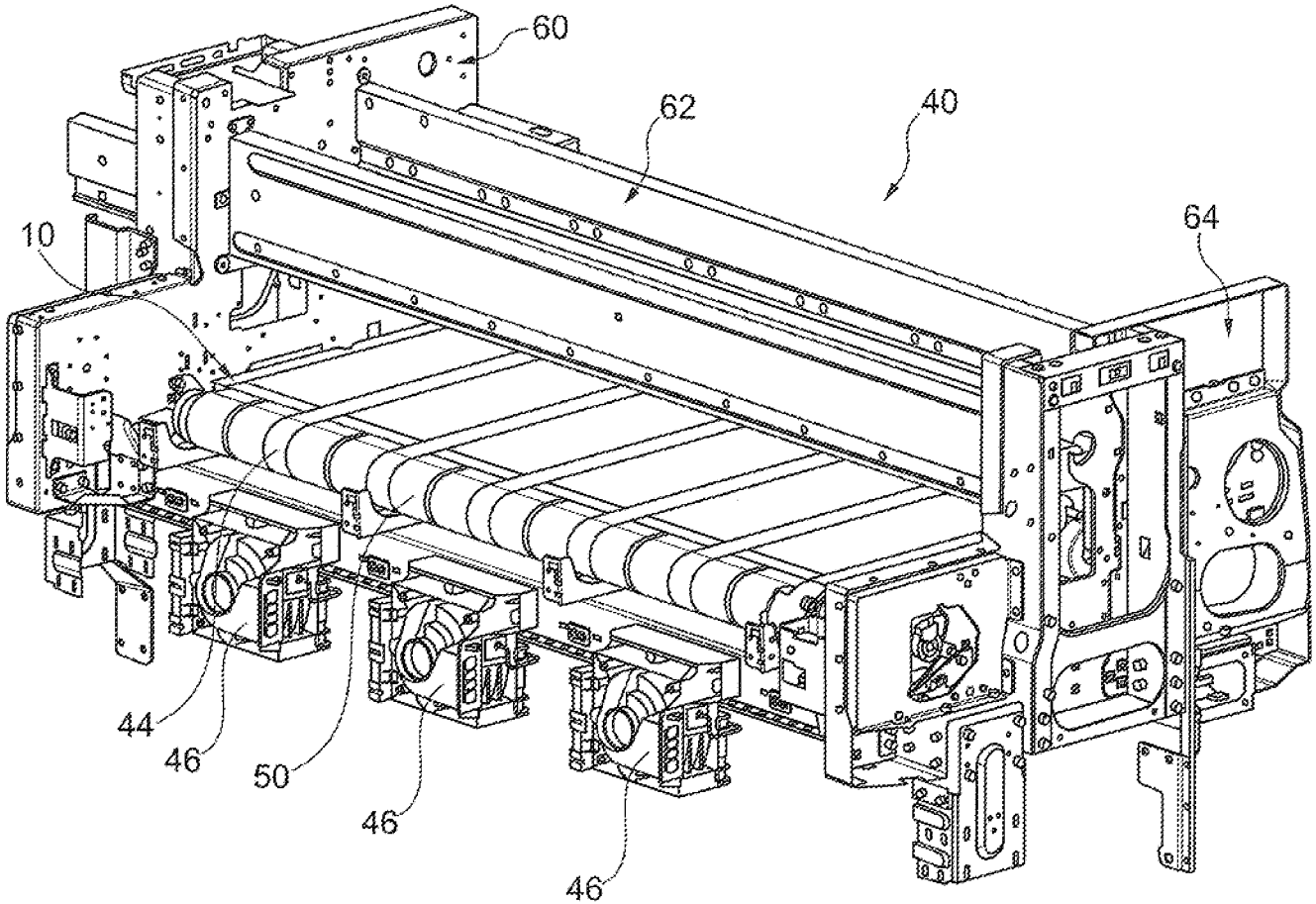
FIG. 8 shows an example of a print zone and top structure of a large format printer.

FIG. 8 shows a completely assembled vacuum print platen sub-system of a large format printer. In addition to the parts already described, FIG. 8 shows the print platen sub-system with three print platen modules 10 mounted side by side and with a number of vacuum belts 50 running across the surface of the print platen modules 10 and around the vacuum belt rollers 44. FIG. 8 additionally shows a support structure 60, 62, 64 which could be used for mounting a printhead, a printhead bar, a scanner or other printer sub-systems.

In one example, the present disclosure hence provides a print zone assembly comprising a print platen device including at least a section of a print platen, having a first or longitudinal dimension and a second or transverse dimension, the second dimension being perpendicular to the first dimension, wherein the print platen device is relatively rigid in the direction of the second dimension and less rigid in the direction of the first dimension; and further comprising a platen support structure supporting the print platen device at a number of references, establishing a multi-point contact, wherein the print platen device conforms to the references for providing a flat platen surface.

In another example, the present disclosure provides a print platen module, including a molded platen section, having a transverse dimension and a longitudinal dimension, and a number of stiffening ribs connected to the print platen section, extending in the transverse direction wherein the print platen module is relatively rigid in the transverse direction and less rigid in the longitudinal direction. In one of more examples, the print platen module further includes a vacuum chamber comprising a pan made of a soft flexible material when compared to the material of the print platen section, the pan being connected to a bottom side of the print platen section and being sufficiently twistable so as to introduce no or negligible torsion when connected to the print platen module.

In another example, the present disclosure provides a large format printer including a support structure; and a print platen device extending across and supported by the support structure; wherein the print platen device comprises a number of print platen modules, each module including molded platen parts and a number of stiffening ribs integrated with the molded platen parts, wherein the print platen modules are fitted together to form a printer platen; and wherein the support structure comprises a number of adjustable beams supporting the print platen modules; and wherein the print platen device has a rigidity in a transverse direction lower than a rigidity in a longitudinal direction. Each module further includes a vacuum chamber comprising a pan defining a cavity wherein the pan is made from a soft, flexible material when compared to the material of the print platen section, the vacuum chamber connected to a bottom side of the print platen part.

The invention claimed is:

1. A print zone assembly, comprising:

a print platen device, including:

a print platen section having a first dimension and a second dimension, a direction of the second dimension being perpendicular to a direction of the first dimension, wherein, the print platen device has a lower rigidity in the direction of the first dimension than in the direction of the second dimension; and a number of stiffening ribs extending along a bottom side of the print platen section in the direction of the second dimension; and a platen support structure supporting the print platen device at a number of references, establishing a multipoint contact, wherein the print platen device is deformable at least in the direction of the first dimension so as to conform to the references for providing a flat platen surface, the platen support structure comprising an adjustment mechanism to allow the print platen device to be supported at a predetermined flatness.

2. The print zone assembly of claim 1, wherein the first dimension is a longitudinal dimension in a direction of print media transport and the second dimension is a transverse dimension.

3. The print zone assembly of claim 1, wherein the platen support structure comprises at least four reference points, and wherein the print platen device allows for limited torsional movement during assembly to contact said at least four reference points.

4. The print zone assembly of claim 1, wherein:

the print platen device comprises a plurality of print platen modules that are fitted together to form a print platen, each print platen module comprising a molded print platen section and a plurality of stiffening ribs extending along a bottom side of the print platen section in the direction of the second dimension.

5. The print zone assembly of claim 4, wherein the platen support structure comprises a number of adjustable beams supporting the print platen modules.

6. The print zone assembly of claim 4, wherein the stiffening ribs comprise sheet metal parts and the print platen section is formed by injection molding, wherein the stiffening ribs are .overmolded during injection molding of the print platen section.

7. The print zone assembly of claim 4, wherein each print platen module has a stiffness in the direction of the second dimension which is about 100 times to 200 times its stiffness in the direction of the first dimension.

8. The print zone assembly of claim 4, wherein each print platen module further comprises a vacuum chamber comprising a pan defining a cavity, wherein the pan is made from a soft flexible material when compared to the material of the print platen section, wherein the vacuum chamber is connected to a bottom side of the print platen section.

9. The print zone assembly of claim 8, wherein the flexural inertia moment of the print platen section in the direction of the second dimension is about 10000 times to 100000 times that of the pan.

10. The assembly of claim 8, wherein the vacuum chamber comprises a thermoformed polymer pan having a corrugated surface structure to provide a vacuum chamber which supports a vacuum level of about $2.5 \cdot 10^3$ N/m2 and which is sufficiently twistable so as to introduce no or negligible torsion when connected to the print platen device.

11. The print platen module of claim 4, wherein each print platen module comprises a fitting edge to engage with an adjacent print platen module in an overlapping manner to form the print platen.

12. The print zone assembly of claim 1, wherein the number of stiffening ribs includes a plurality of stiffening ribs disposed along the direction of the first dimension and extending in the direction of the second dimension.

13. A large format printer, comprising:

a support structure; and a print platen device extending across and supported by the support structure, wherein:

the print platen device comprises a number of print platen. modules, each module including molded platen parts and a number of stiffening ribs integrated with the molded platen parts, wherein the print platen modules are fitted together to form a printer platen;

the support structure comprises a number of adjustable beams supporting the print platen modules; and the print platen device has a rigidity in a transverse direction higher than a rigidity in a longitudinal direction; and wherein each print platen module further comprises:

a vacuum chamber comprising a pan defining a cavity, wherein the pan is made from a soft flexible material when compared to the material of the print platen module, the vacuum chamber connected to a bottom side of the print platen module.

* * * * *